US006843078B2

(12) United States Patent
Rock et al.

(10) Patent No.: US 6,843,078 B2
(45) Date of Patent: Jan. 18, 2005

(54) EMI SHIELDING FABRIC

(75) Inventors: Moshe Rock, Brookline, MA (US); Vikram Sharma, Stoneham, MA (US)

(73) Assignee: Malden Mills Industries, Inc., Lawrence, MA (US)

( * ) Notice: Subject to any disclaimer, the term of this patent is extended or adjusted under 35 U.S.C. 154(b) by 195 days.

(21) Appl. No.: 10/349,554

(22) Filed: Jan. 23, 2003

(65) Prior Publication Data

US 2004/0023576 A1 Feb. 5, 2004

Related U.S. Application Data

(60) Provisional application No. 60/386,179, filed on Jan. 25, 2002.

(51) Int. Cl.[7] ..... D04B 21/04

(52) U.S. Cl. ..... 66/202; 66/170; 66/171; 66/194

(58) Field of Search ..... 66/202, 170, 171, 66/191–195; 442/316, 312, 132, 133

(56) References Cited

U.S. PATENT DOCUMENTS

| | | | | |
|---|---|---|---|---|
| 3,164,480 | A | | 1/1965 | Reynolds |
| 4,030,892 | A | | 6/1977 | Mendelsohn et al. |
| 4,322,232 | A | * | 3/1982 | Beane ..... 66/136 |
| 4,572,960 | A | | 2/1986 | Ebneth et al. |
| 4,923,741 | A | | 5/1990 | Kosmo et al. |
| 5,073,984 | A | | 12/1991 | Tone et al. |
| 5,103,504 | A | | 4/1992 | Dordevic |
| 5,275,861 | A | | 1/1994 | Vaughn |
| 5,569,877 | A | | 10/1996 | Yumi |
| 5,578,359 | A | | 11/1996 | Forbes et al. |
| 5,603,514 | A | * | 2/1997 | Jencks et al. ..... 174/35 GC |
| 5,948,708 | A | | 9/1999 | Langley |
| 5,968,854 | A | | 10/1999 | Akopian et al. |
| 6,077,793 | A | | 6/2000 | Hatjasalo et al. |
| 6,160,246 | A | | 12/2000 | Rock et al. |
| 6,160,248 | A | | 12/2000 | Ottenwaelder et al. |
| 6,215,111 | B1 | | 4/2001 | Rock et al. |
| 6,307,189 | B1 | | 10/2001 | Rock et al. |
| 6,373,034 | B1 | | 4/2002 | Rock et al. |
| 6,414,286 | B2 | * | 7/2002 | Rock et al. ..... 219/545 |
| 2001/0022298 | A1 | | 9/2001 | Rock et al. |

FOREIGN PATENT DOCUMENTS

| | | |
|---|---|---|
| DE | 197 28 386 A1 | 1/1999 |
| DE | 199 56 320 A1 | 6/2001 |

* cited by examiner

*Primary Examiner*—Danny Worrell
(74) *Attorney, Agent, or Firm*—Fish & Richardson P.C.

(57) ABSTRACT

An electrically conductive fabric for use in articles of clothing worn for shielding against electromagnetic radiation includes a knit body with a first broad surface and an opposite, second broad surface where at least one of the surfaces includes a fleece or raised surface. The conductive fabric further includes stitch yarns of electrically conductive fibers and loop yarns comprising non-conductive fibers. The non-conductive fibers of the loop yarns are finished upon at least one of the first broad surface and second broad surface to form the fleece or raised surface, with electrically conductive fibers of the stitch yarns being embedded among the non-conductive fibers and between and spaced from the first and the second broad surfaces.

32 Claims, 3 Drawing Sheets

EMI SHIELDING FABRIC

CLAIM OF PRIORITY

This application claims benefit from U.S. Provisional Application No. 60/386,179, filed Jan. 25, 2002. The complete disclosures of all of the above-listed patents and patent applications are incorporated herein by reference.

TECHNICAL FIELD

This invention relates to electrically conductive fabrics, and more particularly to electrically conductive fabrics suitable for use in clothing articles worn to provide shielding against electromagnetic radiation (EMI).

BACKGROUND

Human exposure to electromagnetic radiation can be minimized through utilization of an EMI shield. Specially manufactured clothing or fabric comprised of conductive elements can be used to provide such shielding. Shielding can be provided to protect against electromagnetic radiation in clothing by providing the clothing fabric with a metallic coating or metallic electro-chemical deposition, or by incorporating surface-metallized or other conductive fibers into the fabric construction, or by forming the fabric from yarns or threads containing metallic fibers. While articles of fabric may be effective, at varying degrees, at shielding a wearer from EMI radiation, the articles need also be flexible and stretchy rather than too stiff or "boardy". Such stiff or "boardy" clothing decreases a wearer's comfort level during wearing.

SUMMARY

In one aspect, the invention features an electrically conductive fabric for use in articles of clothing worn for shielding against electromagnetic radiation. The electrically conductive fabric includes a knit body having two broad surfaces. On at least one of the broad surfaces, there is a fleece or raised surface. The knit body is made up of electrically conductive stitch yarns and non-conductive loop yarns that are knit together to form the body. The non-conductive fibers of the loop yarns are finished upon at least one of the broad surfaces to form the fleece or raised surface. Embedded among the non-conductive fibers are the electrically conductive stitch yarns, which are between and spaced from the broad surfaces.

In another aspect, the invention features articles of wearing apparel comprising an electrically conductive fabric for shielding a wearer against electromagnetic radiation. The fabric includes a knit body having a first broad surface and an opposite, second broad surface. At least one of the broad surfaces has a fleece or a raised surface. The knit body is formed of stitch yarns and loop yarns where the stitch yarns include electrically conductive fibers and the loop yarns include non-conductive fibers. The non-conductive fibers are finished upon at least one of the broad surfaces to form the fleece or raised surface. The electrically conductive fibers of the stitch yarns are embedded among the non-conductive fibers, the conductive fibers being between and spaced apart from the broad surfaces.

Implementations of these aspects of the invention may include one or more other features. For example, the loop yarns may overlap the stitch yarns on both the broad surfaces of the knit body forming a barrier of non-conductive material about the stitch yarn. By forming this protective barrier of non-conductive material, each of the broad surfaces can be finished to form the fleece or raised surface on both broad surfaces of the fabric body. Additionally, the stitch yarn may also comprise non-conductive fibers, including stretchy materials, to allow for varying distributions of electrically conductive elements along the knit body. The fleeced surface may also be formed upon the knit body in a manner to avoid damage to conductivity performance of the electrically conductive fibers of the stitch yarn.

Additional implementations may include electrically conductive fibers of various materials including conductive, continuous filaments, staples, stainless steel fibers, silver-coated nylon yarns, polyester fibers, silver-embedded fibers and/or Nano-tube carbon particle-embedded fibers. The denier of the loop yarns and stitch yarns may also vary. The loop yarn may include spun yarns having a denier between about 40 denier to 300 denier. The stitch yarn may include a spun yarn or a filament yarn having a denier between about 50 denier to 150 denier. The stitch yarn may also include various stretchy materials such as spandex, for example, providing added comfort.

Further implementations may include varying additional parameters of the fabric body. For example, the conductive fibers can have a resistivity between about $10^3$ to $10^9$ ohms/cm and/or the conductive fibers may only be used as the stitch yarn. Also, the number of conductive elements per unit length may vary depending on the particular application, for example, the fabric body may have 20 conductive fibers per centimeter. In addition to the spacing of conductive elements, it may be preferable, depending on the application, to position the fabrics in either a symmetrical pattern and/or an asymmetrical pattern along at least a portion of the fabric body. By varying at least one of the parameters noted above, a fabric body can be created that is tailored to a particular application.

Implementations of aspects of the invention may also include finishing the loop yarns to create the fleece or raised surface by employing certain methods including napping, sanding, and/or brushing, as examples. Preferably, the fabric is formed using standard reverse plaiting circular knitting. Additionally, the conductive fabric can be treated to render the fabric, for example, either hydrophilic or hydrophobic. Furthermore, the conductive elements may form a mesh to provide an electrical connection between conductive fibers and/or the conductive fabric may include buses that connect conductive fibers. The buses may be formed of stitching of conductive yarn and/or of a narrow conductive fabric, as examples. The buses may be attached by, for example mechanical fasteners, such as snaps and/or the buses may be attached by stitching. The buses may be formed along edge regions of the fabric body and/or they may be spaced-apart along the body of the fabric.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

This patent application is related to earlier patent applications filed by me jointly with Vikram Sharma, as follows: U.S. application Ser. No. 09/296,375, filed Apr. 22, 1999 (now abandoned); U.S. application Ser. No. 09/395,326, filed Sep. 13, 1999 (now U.S. Pat. No. 6,160,246, issued Dec. 12, 2000); U.S. application Ser. No. 09/468,627, filed Dec. 21, 1999 (now U.S. Pat. No. 6,215,111, issued Apr. 10, 2001); and U.S. application Ser. No. 09/703,089, filed Oct. 31, 2000 (now U.S. Pat. No. 6,307,189, issued Oct. 23, 2001; the complete disclosures of all of which are incorporated herein by reference.

Figure 2:
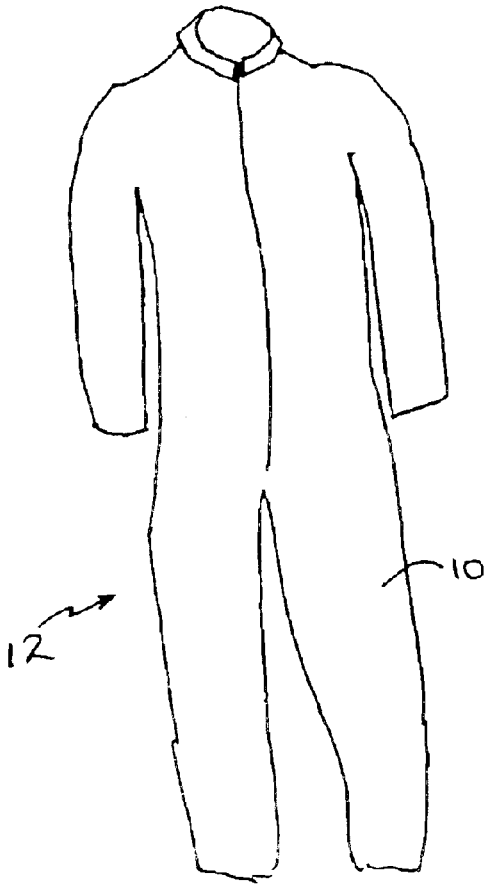
FIG. 2 is a somewhat diagrammatic perspective view of an article of clothing, in this embodiment, a coverall, formed of electrically conductive fabric of the invention, to be worn for personal protection, i.e., shielding, against electromagnetic radiation (EMI).
Figure 3:
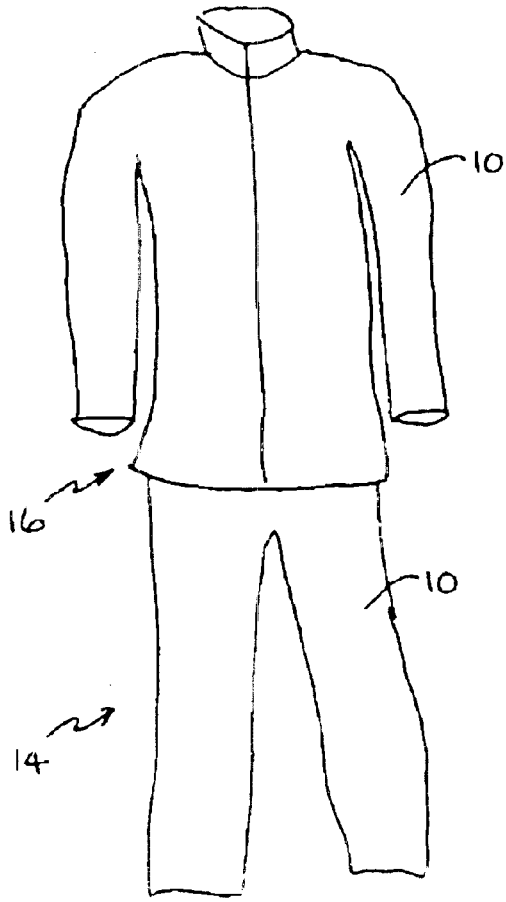
FIG. 3 is a similar view of articles of clothing, in this embodiment, pants and a shirt, formed of electrically conductive fabric of the invention, to be worn for personal protection, i.e., shielding, against electromagnetic radiation (EMI).
Figure 1:
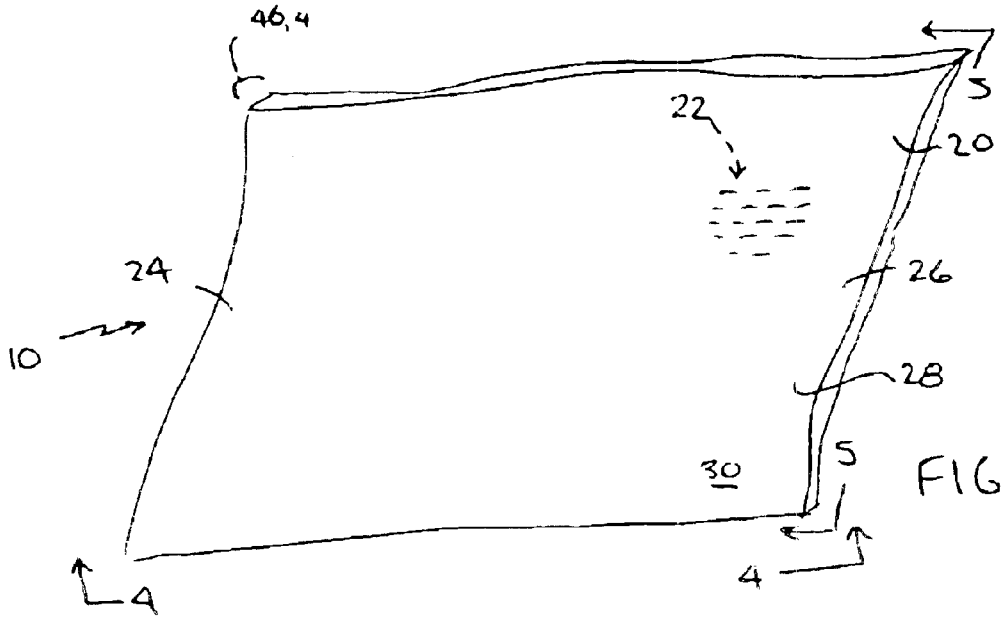
FIG. 1 is a perspective view of an electrically conductive fabric of the invention particularly suited for use in clothing articles worn for personal protection or shielding against electromagnetic radiation (EMI).

Referring to FIGS. 1–3, the invention relates to an improved electrically conductive fabric 10 particularly suited for use in clothing, e.g., coveralls 12 (FIG. 2) or pants 14 and shirt or blouse 16 (FIG. 3), worn to provide personal protection or shielding against electromagnetic radiation (EMI).

Figure 4:
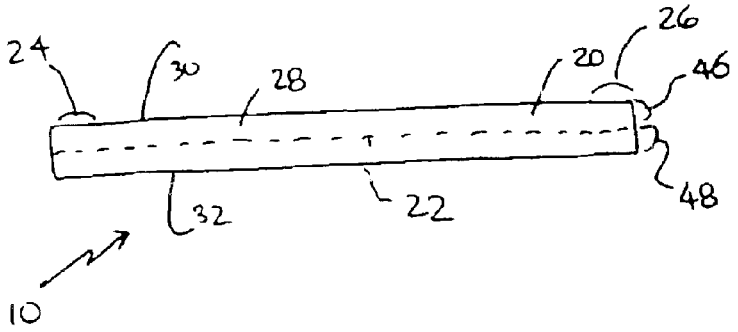
FIG. 4 is an end section view of the electrically conductive fabric of the invention, taken at the line 4—4 of FIG. 1.
Figure 5:
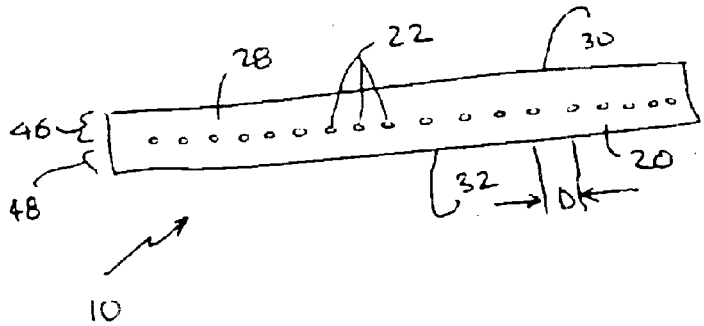
FIG. 5 is a side section view of the electrically conductive fabric of the invention, taken at the line 5—5 of FIG. 1.
Figure 7:
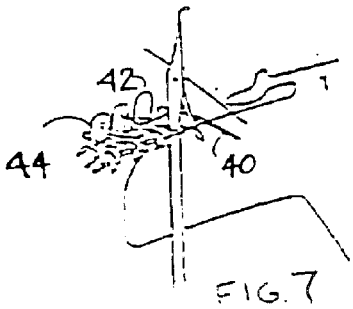
FIGS. 7–13 are sequential views of a cylinder latch needle in a reverse plaiting circular knitting process, e.g., for use in forming an electric heating/warming composite fabric article of the invention.
Figure 8:
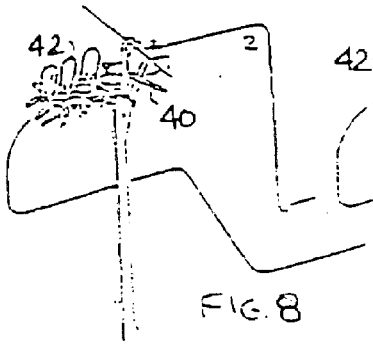
Figure 9:
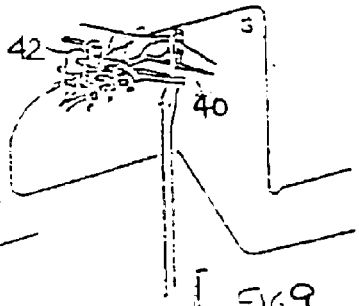
Figure 10:
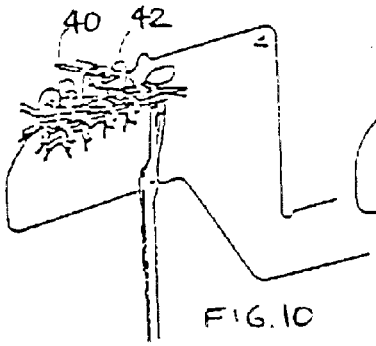
Figure 11:
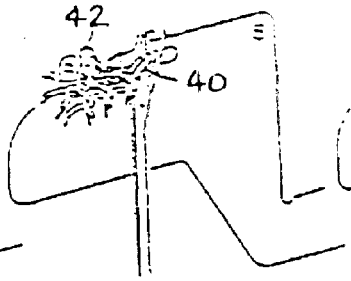
Figure 12:
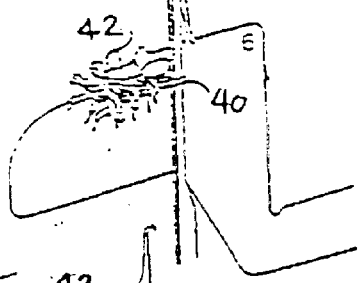
Figure 13:
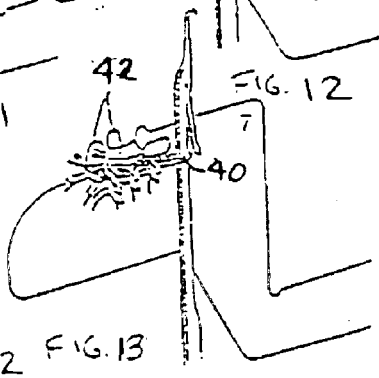
Figure 6:
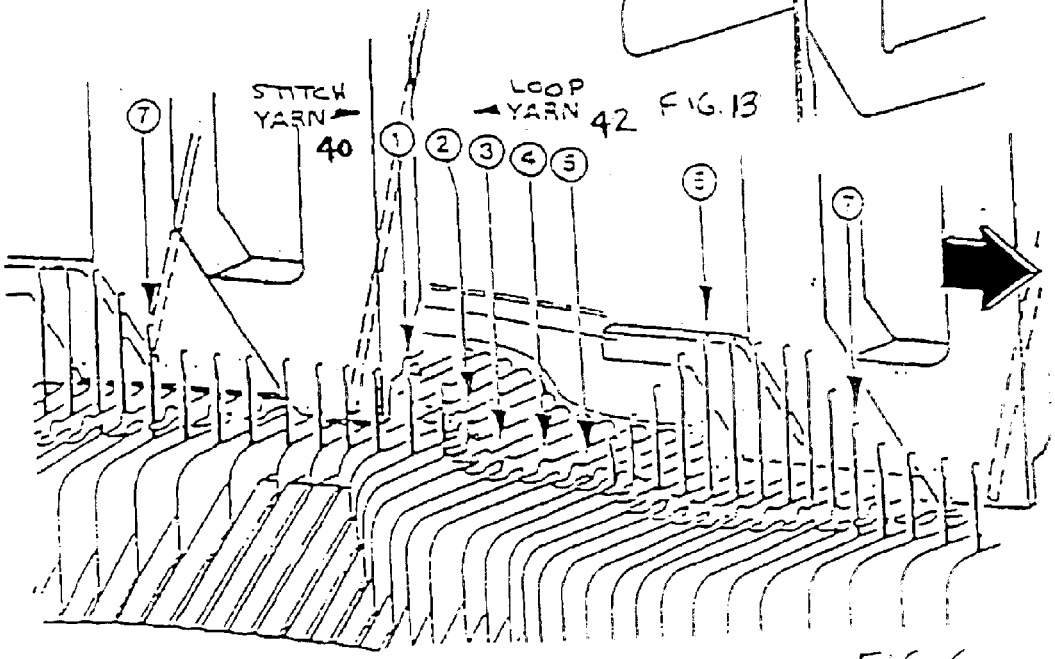
FIG. 6 is a perspective view of a segment of a circular knitting machine.

Referring next to FIGS. 1, 4 and 5, the improved electrically conductive fabric 10 of the invention, suitable for use in clothing to be worn for personal protection or shielding against electromagnetic radiation (EMI), consists of a fabric body 20 formed, e.g., by reverse terry circular knitting with electrically conductive elements 22 incorporated into the fabric as the stitch yarn and extending generally between edge regions 24, 26 of the fabric to provide shielding. Non-conductive yarns 28 are incorporated as stitch yarn 40 and loop yarn 42, the loop yarns overlaying the stitch yarns at the technical face 30 and forming loops 44 (FIG. 7) at the technical back 32 of the fabric body 20. The fibers of the non-conductive yarns 28, preferably of the loop yarn 42, are then napped at the technical face 30 and technical back 32 to form a layer of fleece 46, 48 at each face, which keeps the electrically conductive shielding elements 22 away from the wearer's skin, including for enhancement of wearer comfort, and also protects the electrically conductive elements 22 from physical abrasion. According to the invention, the napping of fibers of non-conductive yarns 28 at the technical face 30 and technical back 32 is also performed in a manner to avoid damage to the conductivity of the electrically conductive elements 22. In preferred embodiments, the electrically conductive elements 22 of the stitch yarn 40 may be continuous filaments or may be a blend of staples (conductive or conductive and non-conductive) of relatively short length, e.g., stainless steel yarn/fibers, silver-coated nylon yarns, or polyester or other synthetic fibers with silver or Nano-tube carbon particles embedded therein. An example is BEKITEX® textile yarn made out of nylon fibers and stainless steel fibers, available from N. V. Bekaert S. A., of Zwevegem, Belgium.

Referring also to FIGS. 6–13, in a preferred embodiment, the fabric body 20 is formed by joining a stitch yarn 40 and a loop yarn 42 in a standard reverse plaiting circular knitting (terry knitting) process, e.g. as described in "Knitting Technology," by David J. Spencer (Woodhead Publishing Limited, 2nd edition, 1996), the entire disclosure of which is incorporated herein by reference. Referring again to FIGS. 1, 4, and 5, in the terry knitting process, the stitch yarn 40 forms the technical face 30 of the resulting fabric body 20 and the loop yarn 42 forms the opposite technical back 32, where it is formed into loops 44 extending over the stitch yarn 40. In the fabric body 20 formed by reverse plaiting circular knitting, the loop yarn 42 is preferentially exposed outwardly from the planes of both surfaces 30, 32 and, on the technical face 30, the loop yarn 42 covers the stitch yarn 40. As a result, during napping of the opposite fabric surfaces to form a fleece, the loop yarn 42 protects the electrically conductive elements 22 knitted into the fabric body 20 in the stitch yarn position.

The loop yarn 42 forming the technical back 32 of the knit fabric body 20 can be made of any synthetic or natural material. The cross section and luster of the fibers or the filament may be varied, e.g., as dictated by requirements of the intended end use. The loop yarn 42 can be a spun yarn made by any available spinning technique, or a filament yarn made by extrusion. The loop yarn denier is typically between 40 denier to 300 denier. A preferred loop yarn is a 200/100 denier T-653 Type flat polyester filament, e.g. as available commercially from E. I. duPont de Nemours and Company, Inc., of Wilmington, Del.

The stitch yarn 40 forming the technical face 30 of the knit fabric body 20 can be also made of non-conductive yarn, such as synthetic or natural materials in a spun yarn or a filament yarn. The denier is typically between 50 denier to 150 denier. A preferred yarn is a 70/34 denier filament textured polyester, e.g. as available commercially from UNIFI, Inc., of Greensboro, N.C.

The resistivity of the electrically conductive elements 22 can be selected in the range, e.g., of from about $10^3$ ohms/cm to about $10^9$ ohms/cm on the basis of end use requirements of the fabric 10. However, electrically conductive elements 22 performing outside this range can also be employed, where required or desired.

As mentioned above, in a preferred method of the invention, the fabric body 20 is formed by reverse plaiting on a circular knitting machine. This is principally a terry knit, where the loops formed by the loop yarn 42 cover the stitch yarn 40 on the technical face 30. The electrically conductive elements 22 are incorporated into the knit fabric body 20 formed on the circular knitting machine at a predetermined spacing or distance apart, D (FIG. 5). In a fabric body 20 of the invention, the spacing, D, is typically a function, e.g., of the requirements of EMI shielding desired in the clothing articles to be formed. For example, the spacing of electrically conductive elements 22 may be the range of about 0.02 inch (i.e., with about 50 electrically conductive elements/inch or about 20 electrically conductive elements/cm). However, other spacing may be employed, depending on the conditions of intended or expected use, including the conductivity of the electrically conductive elements 22. The electrically conductive elements 22 may be spaced symmetrically from each other, or the electrically conductive elements 22 may be spaced asymmetrically, with varying spacing, if desired.

Also as mentioned above, a preferred position of the electrically conductive elements 22 is in the stitch position of the circular knitted construction. The electrically conductive elements 22 may then be knit symmetrically, i.e., at a predetermined distance, D, apart, in each repeat, i.e., the electrically conductive elements 22 can be in stitch position at any feed repeat of the circular knitting machine. If desired, e.g., in order to maximize EMI shielding, the electrically conductive elements 22 may be used entirely as the stitch yarn 40. Alternatively, the feed position may be varied, and the electrically conductive elements 22 may be knit asymmetrically, with the elements more closely or widely spaced, e.g., as desired or as appropriate to the intended product use. Again, the specific number of feeds, and the spacing of the electrically conductive elements 22, is dependent on the end use requirements.

Furthermore, the shielding provided by the fabric at a given electromagnetic frequency can be optimized by varying certain parameters such as the conductivity of the conductive elements, the gauge of the knitting machine and the distribution of the conductive elements in the fabric construction. For example, the resistivity of the conductive elements can be varied between $10^3$ ohms/cm to $10^9$ ohms/cm and/or the gauge of the knitting machine can be varied between 12 to 40. As noted above, the distribution of the electrically conductive elements may be symmetrical or asymmetrical, depending on the end use requirements. Additionally, the spacing of the electrically conductive elements may be increased or decreased. By varying knitting parameters, an EMI shielding fabric, such as an article of clothing, can be created having varying shielding effects along the fabric body.

Preferably the knitted fabric body 20 incorporating the electrically conductive elements 22 is next subjected to finishing. During the finishing process, the fabric body 20 may go through processes of, e.g., sanding, brushing, napping, etc., to generate a fleece 46, 48. The fleece 46, 48 may be formed on one face of the fabric body 20, e.g., on the technical back 32, in the loop yarn 42, or, preferably, a fleece 46, 48 may be formed on both faces of the fabric body 20, including on the technical face 30, in the overlaying loops 44 of the loop yarn 42 and/or in the stitch yarn 40. In either case, the process of generating the fleece 46, 48 on the face or faces of fabric body 20 is preferably performed in a manner to avoid damage to the electrically conductive elements 22 that are part of the construction of the fabric body 20. In particular, the fleece 46, 48 is formed in a manner that avoids damage to the electrically conductive elements 22 that would result in a reduction in conductivity, or would sever the electrically conductive elements 22 completely, which could result in loss of electrical flow, and shielding, in a region of the clothing. The fabric body 20 may also be treated, e.g., chemically, to render the material hydrophobic or hydrophilic.

Figure 14:
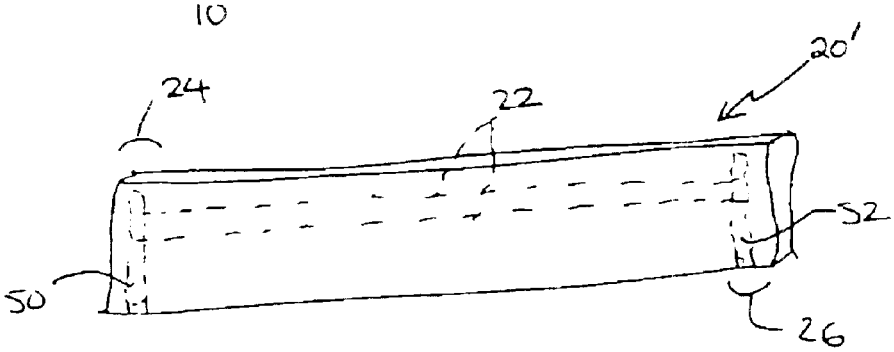
FIGS. 14 and 15 are somewhat diagrammatic perspective views of other embodiments of the electrically conductive fabric of the invention.
Figure 15:
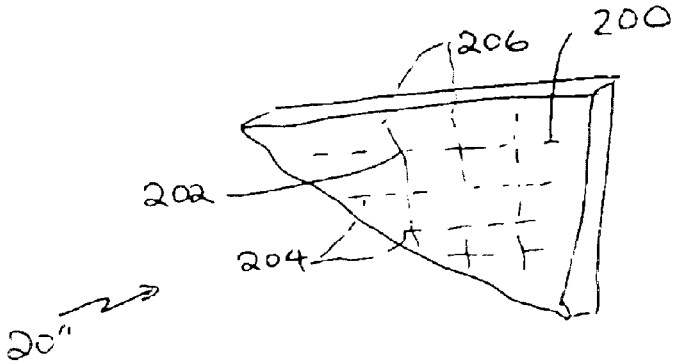

Referring to FIG. 14, electrical connection between electrically conductive elements 22 may be provided by formation of buses 50, 52 along the edge regions 24, 26 of the fabric body 20 and/or spaced-apart in the body, e.g., as described in Rock et al. U.S. Pat. 6,373,034, issued Apr. 16, 2002, the complete disclosure of which is incorporated herein by reference, and/or by joining of elements of fabric 20 at clothing seams, e.g., as described in Dordevic U.S. Pat. No. 5,103,504. The buses 50, 52 may be formed by stitching a conductive yarn along the body to connect the conductive elements, or a bus element, e.g. a narrow strip of conductive fabric, may be attached to the fabric, e.g. with mechanical fasteners, such as snaps, or by stitching. Referring to FIG. 15, the electrically conductive elements may also have the form of a mesh or grid 200, preferably with electrical interconnection achieved at intersections 202 of warp and weft electrically conductive elements 204, 206, respectively, in the fabric body 20".

A number of embodiments of the invention have been described. Nevertheless, it will be understood that various modifications may be made without departing from the spirit and scope of the invention. For example, the textile structure can contain a stretchy material, such as spandex, as an example, in the stitch yarn at various predetermined spaced-apart locations throughout the fabric to further improve the comfort level. Further, any type of yarn may be employed.

What is claimed is:

1. An electrically conductive fabric for use in articles of clothing worn for shielding against electromagnetic radiation, the fabric comprising:

a knit body having a first broad surface and an opposite, second broad surface, at least one of which comprises a fleece or raised surface, the knit body comprising:

stitch yarns comprising electrically conductive fibers; and loop yarns comprising non-conductive fibers;

wherein said non-conductive fibers of the loop yarns are finished upon at least one of the first broad surface and second broad surface to form the fleece or raised surface, with electrically conductive fibers of the stitch yarns being embedded among the non-conductive fibers and between and spaced from the first and the second broad surfaces.

2. The conductive fabric of claim 1 wherein the loop yarns overlap the stitch yarns comprising electrically conductive fibers on the first and second broad surfaces of the knit body.

3. The conductive fabric of claim 2 wherein the conductive fabric is finished on the first surface and the second surface forming fleece upon each of the surfaces.

4. The conductive fabric of claim 1 wherein the stitch yarn further comprises non-conductive fibers.

5. The conductive fabric of claim 4 wherein the non-conductive fibers comprise a stretchy material.

6. The conductive fabric of claim 5 wherein the stretchy, non-conductive fibers comprise spandex.

7. The conductive fabric of claim 1 wherein the electrically conductive fibers comprise continuous filaments.

8. The conductive fabric of claim 1 wherein the electrically conductive fibers comprise staples.

9. The conductive fabric of claim 8 wherein the staples comprise at least one of the following: stainless steel fibers, silver-coated nylon yarns, polyester fibers, silver-embedded fibers and Nano-tube carbon particle-embedded fibers.

10. The conductive fabric of claim 1 wherein the loop yarn is a spun yarn having a denier between 40 denier to 300 denier.

11. The conductive fabric of claim 1 wherein the stitch yarn comprises a spun yarn having a denier between 50 denier to 150 denier.

12. The conductive fabric of claim 1 wherein the stitch yarn comprises a filament yarn having a denier between 50 denier to 150 denier.

13. The conductive fabric of claim 1 wherein the conductive fibers have a resistivity between $10^3$ ohms/cm to $10^9$ ohms/cm.

14. The conductive fabric of claim 1 having 20 conductive fibers per cm.

15. The conductive fabric of claim 1 wherein the conductive fibers are spaced symmetrically along at least a portion of the fabric.

16. The conductive fabric of claim 1 wherein the conductive fibers are spaced asymmetrically along at least a portion of the fabric.

17. The conductive fabric of claim 1 wherein the conductive fibers are used only as the stitch yarn.

18. The conductive fabric of claim 1 wherein the loop yarns are finished by napping the loop yarns.

19. The conductive fabric of claim 1 wherein the loop yarns are finished by sanding the loop yarns.

20. The conductive fabric of claim 1 wherein the loop yarns are finished by brushing the loop yarns.

21. The conductive fabric of claim 1 wherein the fabric is formed by standard reverse plaiting circular knitting.

22. The conductive fabric of claim 1 wherein the conductive fabric is treated to render the fabric hydrophobic.

23. The conductive fabric of claim 1 wherein the conductive fabric is treated to render the fabric hydrophilic.

24. The conductive fabric of claim 1 further comprising buses providing an electrical connection between conductive fibers.

25. The conductive fabric of claim 24 wherein the buses are formed of stitching of a conductive yarn.

26. The conductive fabric of claim 24 wherein the buses are formed of a narrow conductive fabric attached to the fabric body.

27. The conductive fabric of claim 26 wherein the buses are attached by a mechanical fastener.

28. The conductive fabric of claim 27 wherein the mechanical fastener comprises a snap.

29. The conductive fabric of claim 26 wherein the buses are attached by stitching.

30. The conductive fabric of claim 1 wherein the conductive fibers form a mesh to form an electrical connection between conductive fibers.

31. The conductive fabric of claim 1 wherein the fleece or raised surface is formed upon the knit body in a manner to avoid damage to conductivity performance of the electrically conductive fibers of the stitch yarn.

32. Articles of wearing apparel comprising electrically conductive fabric for shielding a wearer against electromagnetic radiation, the fabric comprising a knit body having a first broad surface and an opposite, second broad surface, at least one of which comprises a fleece or raised surface, the knit body comprising stitch yarns comprising electrically conductive fibers, and loop yarns comprising non-conductive fibers;

wherein the non conductive fibers of the loop yarns are finished upon at least one of the first broad surface and the second broad surface to form the fleece or raised surface, with electrically conductive fibers of the stitch yarns being embedded among the non-conductive fibers and between and spaced from the first and second broad surfaces.

* * * * *